US007150414B2

(12) United States Patent
Goldin

(10) Patent No.: US 7,150,414 B2
(45) Date of Patent: Dec. 19, 2006

(54) ROTARY DISC ATOMIZER

(76) Inventor: Fima Goldin, 1924 W. 6th St., Apt. #2, Brooklyn, NY (US) 11223

( * ) Notice: Subject to any disclaimer, the term of this patent is extended or adjusted under 35 U.S.C. 154(b) by 289 days.

(21) Appl. No.: 10/699,001

(22) Filed: Nov. 3, 2003

(65) Prior Publication Data

US 2005/0098653 A1 May 12, 2005

(51) Int. Cl.
*B05B 3/10* (2006.01)

(52) U.S. Cl. ..... 239/223; 239/224; 239/225.1; 239/246

(58) Field of Classification Search ..... 239/223, 239/225.1, 232, 237, 240, 246, 224
See application file for complete search history.

(56) References Cited

U.S. PATENT DOCUMENTS 3,749,313 A * 7/1973 Weitmann ..... 239/127
6,550,693 B1 * 4/2003 Lohkamp ..... 239/223
2003/0146309 A1 * 8/2003 Berner et al. ..... 239/681

FOREIGN PATENT DOCUMENTS

JP 05256415 A * 10/1993

* cited by examiner

*Primary Examiner*—Kevin Shaver
*Assistant Examiner*—Jason Boeckmann
(74) *Attorney, Agent, or Firm*—I. Zborovsky

(57) ABSTRACT

A rotary disc atomizer having a disc having an axis and rotatable about the axis, the disc also having two opposite surfaces as considered in an axial direction, and a peripheral edge, the disc having a plurality of throughgoing openings so that when a liquid is supplied to one of the surfaces and flows toward the edge and then droplets are sprayed, the liquid also flows through the throughgoing holes to another of the surfaces so as to also flow radially outwardly on the other surface and form droplets thrown from the edge in a region of the other surface.

14 Claims, 6 Drawing Sheets

ROTARY DISC ATOMIZER

BACKGROUND OF THE INVENTION

The present invention relates to rotary disc atomizers.

Rotary disc atomizers are known in the art. A rotary disc atomizer includes a disc which is rotated at a high speed, and a liquid is supplied on one of its surfaces so that the liquid flows overthe surface to the peripheral edge and then is thrown outwardly from the peripheral edge in form of droplets. Some rotary discs atomizers are disclosed in U.S. Pat. Nos. 4,392,614; 4,860,955; 4,540,124; 5,104,522; 5,219,076; DE 464720; 6550693; in Arcall Brochure "ARCALL 600 i Technology; A revolution in speeding disc spray technology" (WWW.ARCALL.CO.UK). It is believed that the existing rotary disc atomizers can be further improved.

SUMMARY OF THE INVENTION

Accordingly, it is an object of the present invention to provide a rotary disc atomizer which is a further improvement of the existing rotary disc atomizers.

In keeping with these objects and with others which will become apparent hereinafter, one feature of the present invention resides; briefly stated, in the rotary disc atomizer which has a disc having an axis and rotatable about said axis, said disc also having two opposite surfaces as considered in an axial direction, and a peripheral edge, said disc having a plurality of throughgoing openings so that when a liquid is supplied to one of said surfaces and flows toward the edge and then droplets are sprayed from the edge, the liquid also flows through said throughgoing holes to another of said surfaces so as to also flow radially outwardly on said other surface and form droplets thrown from said edge in the region of said other surface.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3:
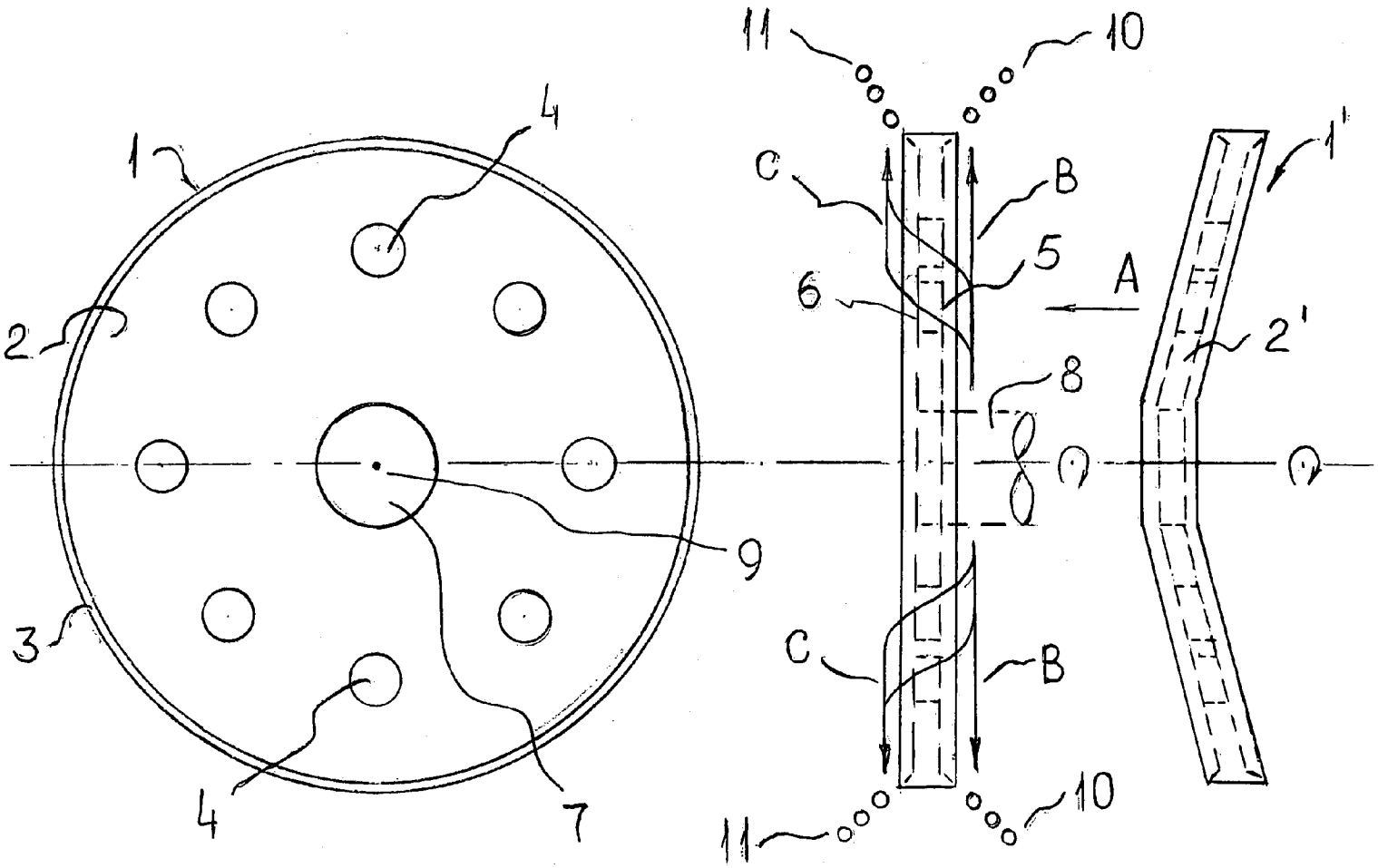
FIG. 1 is a side view of a rotary disc of a rotary disc atomizer in accordance with the present invention.
FIGS. 2 and 3 are end views of the rotary disc in accordance with two embodiments of the present invention.

A rotary disc atomizer in accordance with the present invention has a rotary disc which is identified as a whole with reference numeral 1. The rotary disc 1 has a disc-shaped body 2 and a peripheral edge 3 located in the region of the periphery of the body 2. The body 2 of the rotary disc 1 is provided with a plurality of throughgoing openings 4 which extend through the body 2 and open onto both axial surfaces 5 and 6 of the body 2 which are spaced from one another in an axial direction. The body 2 is provided with a central opening 7 for fixing of the disc 1 on a rotary shaft 8.

The disc-shaped atomizer operates in the following manner:

When a liquid is supplied for example in direction of the arrow A onto one of the surfaces, for example, onto the surface 5, and the disc is rotated by the rotary shaft 8 with a high speed, the liquid flows over the surface 5 radially outwardly as identified with arrow B and in the region of the edge 3 droplets are thrown outwardly of the disc 1 as identified with reference numeral 10. At the same time the liquid flows through the opening 4 to the opposite axial surface 6, then it flows over the opposite axial surface 6 in direction of the arrow C, and then the droplets are thrown from the edge of the surface 6 as identified with reference numeral 11.

As shown in FIG. 2, the disc-shaped body 2 of the disc 1 is substantially flat, or in other words is perpendicular to its axis of rotation 9. FIG. 3 shows another embodiment of the present invention. Here the rotary disc 1' has a disc-shaped body 2' which is concave. Therefore, the flow of liquid over the axially spaced surfaces which are inclined relative to the axis 9 produces droplets 10 and 11 which are directed in correspondence with the shape of the concave disc-shaped body 2'. The concavity of the disc-shaped body 2' can be formed either by straight surfaces which are inclined toward the axis or by curved surfaces (not shown in the drawings).

Figures 4, 5, 6:
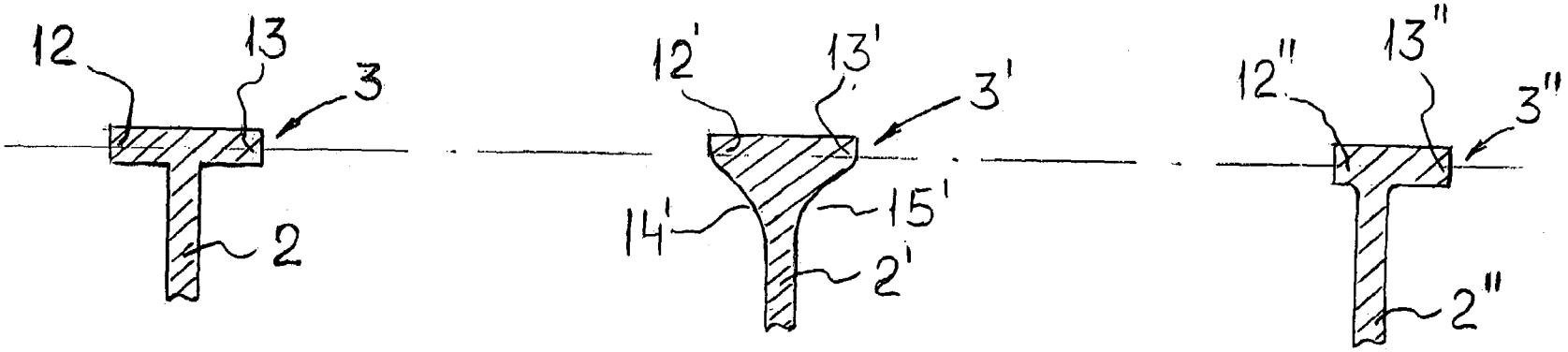
FIGS. 4, 5 and 6 are cross-sections of a peripheral area of the rotary disc in accordance with three different embodiments of the present invention.

The peripheral edge of the rotary disc 1 can be T-shaped and formed for example by two projections 12 and 13 which extend two opposite axial directions from the disc-shaped body 2 of the disc 1 as shown in FIG. 4. In the embodiment shown in FIG. 4, the projections 12 and 13 extend perpendicular to the disc-shaped body 2. FIG. 5 shows another embodiment of the present invention. While here the projections 12' and 13' also extend substantially perpendicularto the disc-shaped body, transitional portions 14' and 15' are provided between the body 2 and the projections 12' and 13' correspondingly, and the transitional portions are curved so as to provide a smoother flow of liquid and lower resistance. In FIG. 6 the projection 12" is shorterthan the projection 13", so that the droplet produced by two opposite surfaces do not mix.

Figure 7:
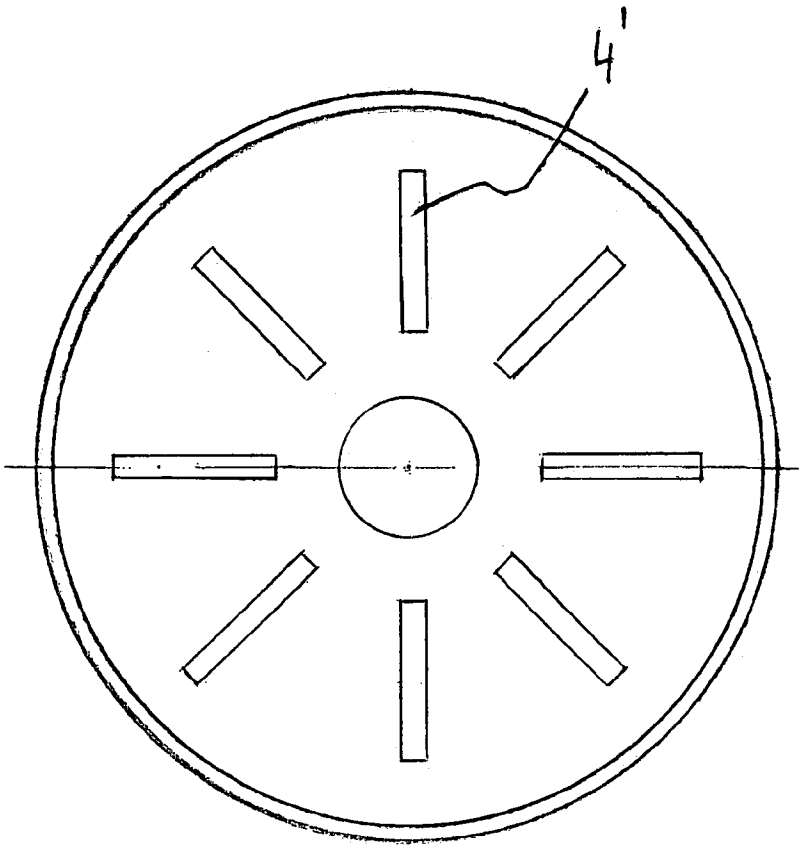

While in the embodiment of FIG. 1 the throughgoing holes 4 are formed as circular holes which are arranged substantially on a single radius it. The holes can be arranged in a different way as well. The holes 4 can be arranged on different radii, in other words on several circles. They can be also offset relative to one another in a different manner. In FIG. 1 the throughgoing holes 4 are circular. In the embodiment shown in FIG. 7, the throughgoing holes 4' are not circular, but instead they are formed as slots. The slots extend in a direction from the central axis 9 toward the peripheral edge 3 of the disc.

Figure 8:
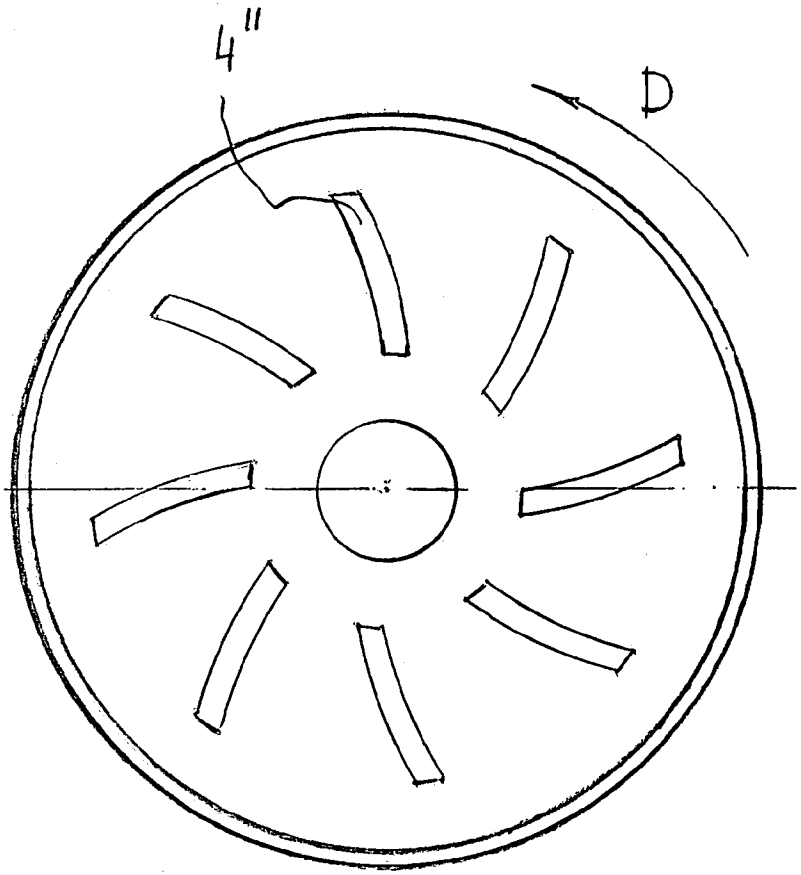
FIGS. 7 and 8 are views substantially corresponding to the view of FIG. 1, but showing two further embodiments of the rotary disc in accordance with the present invention.

In the embodiment of FIG. 8, the openings are also formed as slots 4". The slots 4" however are not straight, but instead they are curved. In a preferable embodiment of the present invention the curvature of each slot is selected so that it is gradually offset, going from the center toward the periphery, from the corresponding radius in a direction corresponding to the direction of rotation of the disc identified with arrow D.

Figure 9:
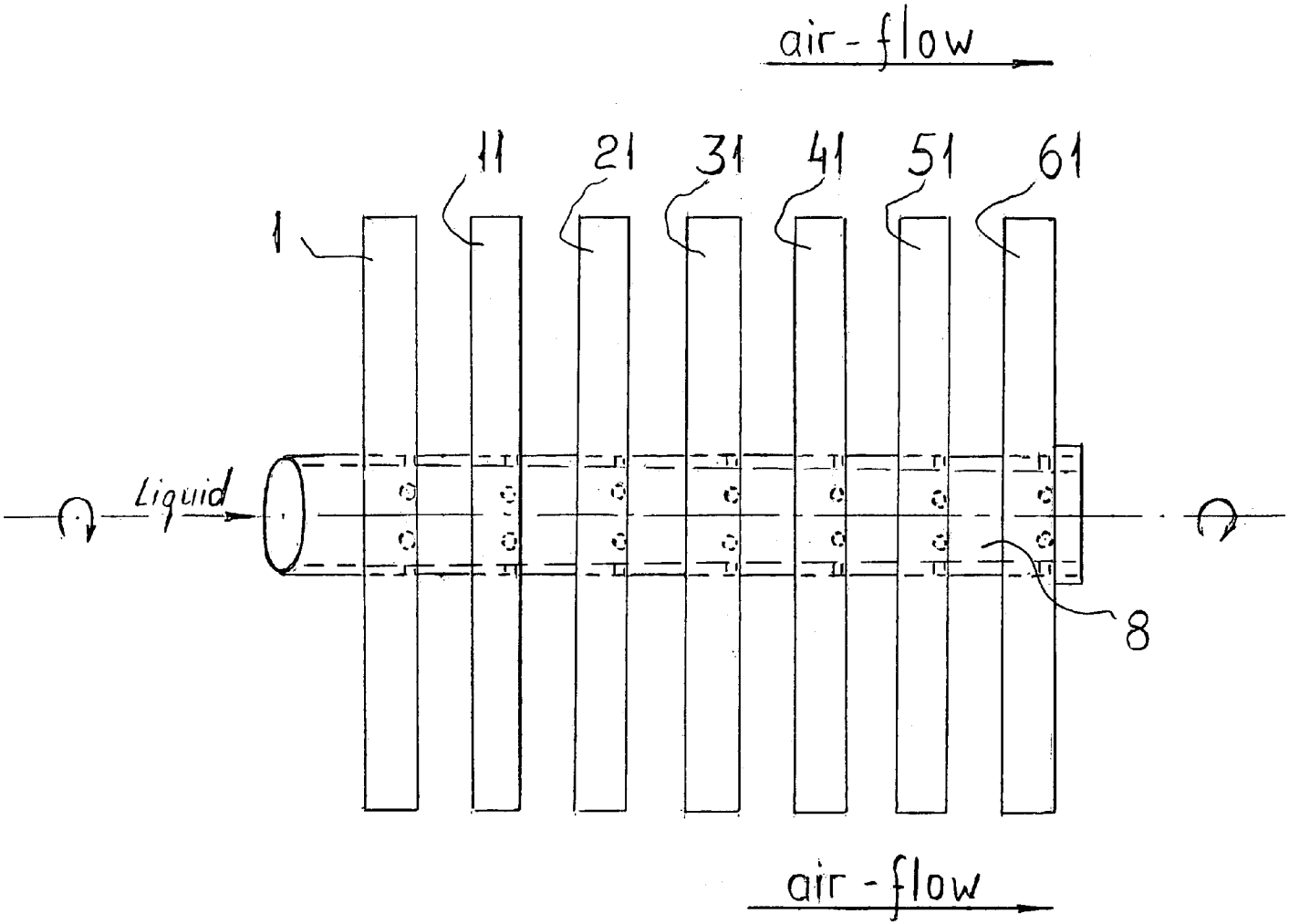
FIGS. 9, 10, 11 are views showing a rotary disc atomizer which includes a plurality of rotary discs, in accordance with three further embodiments of the present invention.

FIG. 9 shows a further embodiment of the present invention. Here the rotary disc atomizer includes a plurality of discs 1, 11, 21, 31, 41, 51, 61, etc., all fixed on the common shaft 8 for joint rotation therewith. The shaft has a plurality of throughgoing openings through which the liquid is supplied onto a corresponding one of the rotary discs. In accordance with one embodiment of the present invention, the inner central opening of the shaft 8 can be conical so as to provide different intensities of flows of the liquid over each disc and as a result different droplet formation at the periphery of each disc, so as to reduce or prevent intermixing of the droplets produced on different discs.

Figure 10:
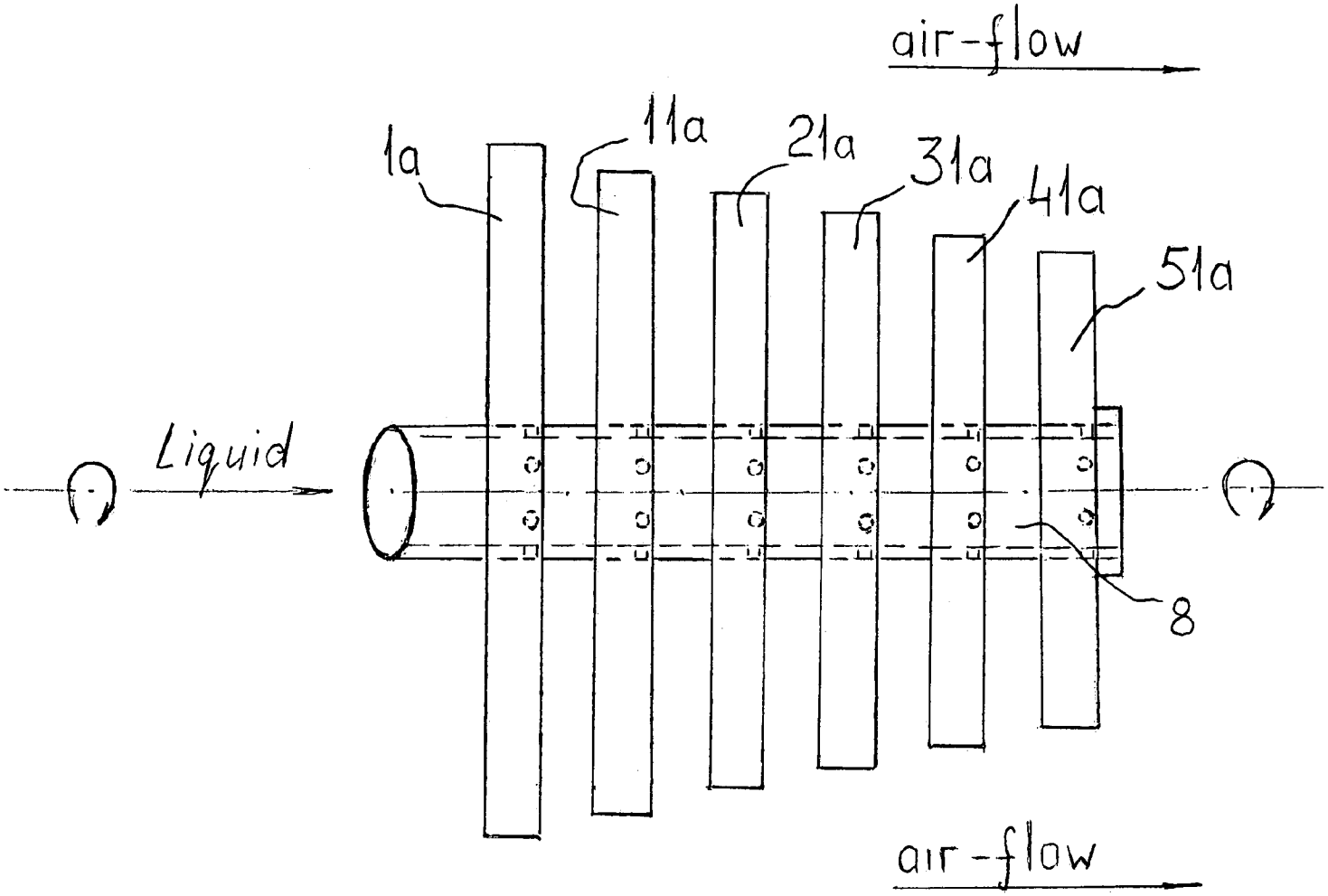

FIG. 10 shows a further embodiment of the present invention which substantially corresponds to the embodiment shown in FIG. 9, but in which the rotary discs 1*a*, 11*a*, 21*a*, 31*a*, 41*a*, 51*a* have different diameters, while the central shaft 8 is cylindrical, hollow and has a central opening of a cylindrical shape. This provides substantially the same effect as in the embodiment of FIG. 9, in particular a different flow of the liquid over different rotary discs and the formation of the droplets so that they do not intermix substantially or at all.

Figure 11:
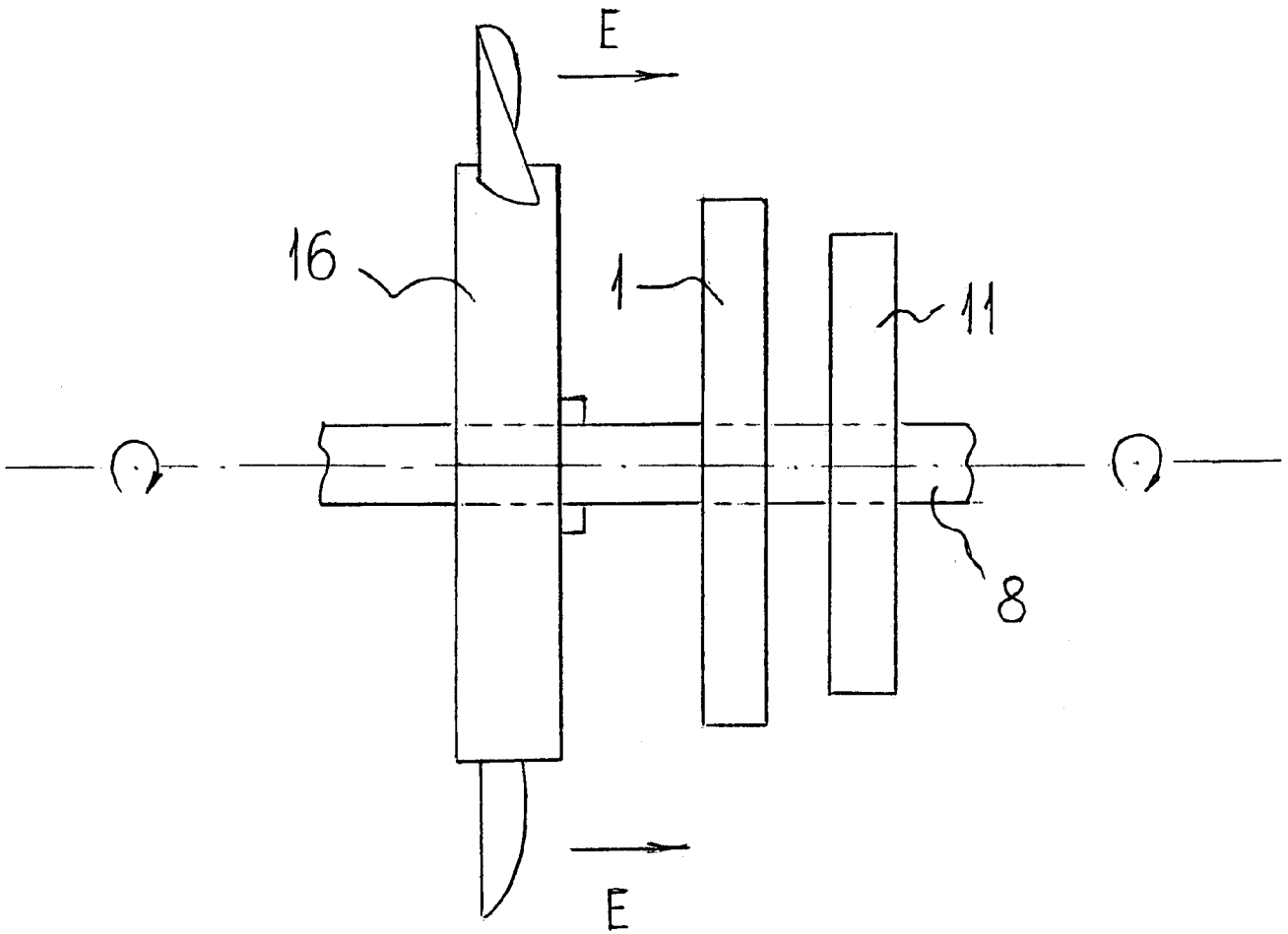

FIG. 11 shows still a further embodiment of the present invention. Here the rotary disc atomizer has the rotary disc 1, or a plurality of rotary discs 1, 11, etc. fixed on the shaft 8. In addition, a fan 16 is also fixed on the shaft 8 and rotates together with the lafter and with the rotary discs. The fan 16 has such a dimension and a design, that it supplies a flow of air in direction of the arrows E selected specifically so as to not to blow onto the surfaces of the discs so as not to interfere with the flow of liquid over the surfaces of the discs, but instead it blows exclusively onto the droplets which are thrown from the peripheral edge of the discs. Therefore, the droplets are forced into a predetermined required direction.

The high-power atomizer in accordance with the present invention can be used in aviation for preventing and extinguishing of forest fires, for protection of forests from diseases and harmful organisms, for agricultural works, for military operations etc. The high-power atomizer in accordance with the invention can be used in agricultural machinery for spraying of grape crops to prevent diseases and protect from harmful organisms, fruit farms, etc. It can be also used in industry for drying processes to dry milk, to spray explosives etc., for creating a microclimate and temperature reduction in hazardous manufacture (metallurgy), for reduction gas pollutions on busy intersections. It can be also used as a portable sprayer for protection of plants from: diseases and harmful organisms on house plots, gardens, nurseries etc., for spraying medications on farms for treating animals, for sanitary treatment of spaces.

It will be understood that each of the elements described above, or two or more together, may also find a useful application in other types of constructions differing from the types described above.

While the invention has been illustrated and described as embodied in rotary disc atomizer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily. adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claim is:

1. A rotary disc atomizer, comprising a disc having an axis and rotatable about said axis, said disc also having two opposite outer surfaces as considered in an axial direction, and a peripheral edge, said disc having a plurality of throughgoing openings so that when a liquid is supplied to one of said outer surfaces and flows toward the edge and then droplets are sprayed, the liquid also flows through said throughgoing holes to the other of said outer surfaces so as to also flow radially outwardly on said other surface and form droplets thrown from said edge in a region of said other surface, wherein said disc has a central disc-shaped body and said peripheral flange extending in two opposite axial directions from both said outer surfaces of said body provided with said openings and forming two oppositely directed projections, wherein one of said projections at a side of a liquid supply is shorter than the other of the said projections.

2. A rotary disc as defined in claim 1, wherein said throughgoing holes are arranged on a circle having a predetermined radius.

3. A rotary disc as defined in claim 2, wherein said throughgoing holes are circular.

4. A rotary disc as defined in claim 1, wherein said throughgoing holes are slot shaped and extending substantially in a direction from said center toward said peripheral edge.

5. A rotary disc as defined in claim 4, wherein slot-shaped holes are substantially curved.

6. A rotary disc as defined in claim 5, wherein each of said slot-shaped holes is inclined relative to a corresponding radius in a direction corresponding to a direction of rotation of said disc.

7. A rotary disc as defined in claim 1, wherein a transition between a corresponding one of said projections and said body of said disc is curved.

8. A rotary disc as defined in claim 1 and further comprising at least one second such disc, said discs being arranged at an axial distance from one another.

9. A rotary disc as defined in claim 8, wherein said discs have identical diameters.

10. A rotary disc as defined in claim 8, wherein said discs have different diameters.

11. A rotary disc as defined in claim 8; and further comprising a shaft on which said discs are mounted, said shaft being hollow and having a plurality of throughgoing openings extending from its hollow interior to its exterior.

12. A rotary disc as defined in claim 11, wherein said shaft is substantially cylindrical.

13. A rotary disc as defined in claim 11, wherein said shaft has a conical inner space.

14. A rotary disc as defined in claim 1 and further comprising a fan arranged coaxially with said disc and operative for blowing air substantially onto the droplets which leave the peripheral edge of said disc so as to direct the droplets in a predetermined direction.

* * * * *